US008741516B2

(12) United States Patent
Kawakami et al.

(10) Patent No.: US 8,741,516 B2
(45) Date of Patent: Jun. 3, 2014

(54) ELECTROSTATIC CHARGE IMAGE DEVELOPING TONER, ELECTROSTATIC CHARGE IMAGE DEVELOPER, TONER CARTRIDGE, DEVELOPER CARTRIDGE, PROCESS CARTRIDGE, IMAGE FORMING APPARATUS, AND IMAGE FORMING METHOD

(75) Inventors: Eiji Kawakami, Kanagawa (JP); Yoshifumi Iida, Kanagawa (JP); Shintaro Anno, Kanagawa (JP); Masahiro Takagi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/566,501

(22) Filed: Aug. 3, 2012

(65) Prior Publication Data

US 2013/0252157 A1 Sep. 26, 2013

(30) Foreign Application Priority Data

Mar. 23, 2012 (JP) ..... 2012-067648

(51) Int. Cl.

| | |
|---|---|
| ***G03G 9/093*** | (2006.01) |
| ***G03G 9/097*** | (2006.01) |
| ***G03G 9/087*** | (2006.01) |

(52) U.S. Cl.

CPC ..... *G03G 9/09716* (2013.01); *G03G 9/09725* (2013.01); *G03G 9/08755* (2013.01)

USPC ..... 430/108.6; 430/108.7; 399/252

(58) Field of Classification Search

CPC ..... G03G 9/08755; G03G 9/09725; G03G 9/09716

USPC ..... 430/108.6, 108.7; 399/252

See application file for complete search history.

(56) References Cited

U.S. PATENT DOCUMENTS

| | | | | |
|---|---|---|---|---|
| 5,695,902 | A | 12/1997 | Mikuriya et al. | |
| 6,190,814 | B1 * | 2/2001 | Law et al. | 430/108.7 |
| 2003/0190540 | A1 * | 10/2003 | Shoshi et al. | 430/78 |
| 2006/0115758 | A1 * | 6/2006 | Chang et al. | 430/109.4 |
| 2010/0196817 | A1 * | 8/2010 | Sasaki et al. | 430/109.4 |

FOREIGN PATENT DOCUMENTS

| | | |
|---|---|---|
| JP | A-9-204065 | 8/1997 |
| JP | A-2005-338690 | 12/2005 |
| JP | A-2007-114648 | 5/2007 |

* cited by examiner

*Primary Examiner* — Peter Vajda

(74) *Attorney, Agent, or Firm* — Oliff PLC

(57) ABSTRACT

An electrostatic charge image developing toner includes toner particles containing a colorant, a binder resin, and a release agent and an external additive, in which the external additive contains inorganic particles which include saturated hydrocarbons having from 9 to 35 carbon atoms on the surfaces thereof.

19 Claims, No Drawings

ELECTROSTATIC CHARGE IMAGE DEVELOPING TONER, ELECTROSTATIC CHARGE IMAGE DEVELOPER, TONER CARTRIDGE, DEVELOPER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2012-067648 filed Mar. 23, 2012.

BACKGROUND

1. Technical Field

The present invention relates to an electrostatic charge image developing toner, an electrostatic charge image developer, a toner cartridge, a developer cartridge, a process cartridge, an image forming apparatus, and an image forming method.

2. Related Art

A method such as electrophotography in which image information is visualized through an electrostatic charge image, is currently being used in various fields. In electrophotography, an electrostatic charge image (electrostatic latent image) is formed on the surface of a photoreceptor (image holding member) through charging and exposure processes; and the electrostatic latent image is developed using a developer containing a toner and visualized through transfer and fixing processes. As the developer used in this case, there is used a two-component developer including a toner and a carrier; and a single-component developer in which a magnetic toner or a nonmagnetic toner is used alone. In addition, as a preparation method of this toner, a kneading and pulverizing method is normally used in which a thermoplastic resin is melted and kneaded along with a pigment, a charge-controlling agent, and a release agent such as wax, cooled, finely pulverized, and classified. Optionally, during toner preparation, inorganic or organic particles for improving fluidity and a cleaning property may be added to the surface of toner particles.

SUMMARY

According to an aspect of the invention, there is provided an electrostatic charge image developing toner including toner particles containing a colorant, a binder resin, and a release agent; and an external additive, in which the external additive contains inorganic particles which include saturated hydrocarbons having from 9 to 35 carbon atoms on the surfaces thereof.

DETAILED DESCRIPTION

Hereinafter, an exemplary embodiment of the invention will be described.

In the exemplary embodiment, "from A to B" includes not only a range between A and B, but also A and B themselves which are both ends thereof. For example, if "from A to B" is a numerical range, the range represents "equal to or greater than A and less than or equal to B" or "equal to or greater than B and less than or equal to A".

Toner for Developing Electrostatic Charge Image

An electrostatic charge image developing toner according to the exemplary embodiment (hereinafter, sometimes simply referred to as "the toner") includes toner particles containing at least a colorant, a binder resin, and a release agent; and an external additive, in which the external additive contains inorganic particles which include saturated hydrocarbons having from 9 to 35 carbon atoms on the surfaces thereof.

In development using a two-component developer, particularly, in magnetic brush development, there are many cases in which, in a cleaning portion, toner, that is, toner particles and an external additive are deposited and deformed; and are caught and remain between a cleaning blade and a photoreceptor (image holding member). Materials which have been deposited over a long period of time become fixed to the cleaning blade, which causes the deterioration of a cleaning property and toner filming on the photoreceptor. As a result, image defects such as color streaks, which are caused by a phenomenon in which toner is not attached, occur. On the other hand, by adding an external additive which is treated with silicone oil, a method of reducing the coefficient of friction with a photoreceptor is proposed (JP-A-9-204065). However, the present inventors have found that, when images are continuously formed for a long time in a high-temperature and high-humidity environment, or when a cartridge or an image forming apparatus is left to stand in a high-temperature and high-humidity environment, silicone oil absorbs moisture, moisture is attached through silicone oil to the surface of toner or a carrier, and thus electric charge leaks from a moisture-attached site, thereby causing image defects such as fogging.

As a result of in-depth examination, the present inventors have found that saturated hydrocarbons having from 9 to 35 carbon atoms have low moisture absorbency and barely absorb moisture even in a high-temperature and high-humidity environment. In addition, the present inventors have found that, by using, as the external additive of the toner, inorganic particles which include saturated hydrocarbons having from 9 to 35 carbon atoms on the surfaces thereof, even when exposed to a high-temperature and high-humidity environment for a long time, the compound does not absorb moisture and suppresses image defects caused by electric charge leakage. Furthermore, the saturated hydrocarbons have excellent capability of reducing the coefficient of friction between the toner and the photoreceptor, thereby suppressing toner attachment to a cleaning blade and suppressing image defects caused by toner filming. Therefore, the electrostatic charge image developing toner according to the exemplary embodiment suppresses both of image defects such as color streaks caused by toner filming and image defects such as fogging caused by electric charge leakage.

External Additive

The electrostatic charge image developing toner according to the exemplary embodiment contains toner particles and an external additive. The external additive contains inorganic particles which include saturated hydrocarbons having from 9 to 35 carbon atoms (hereinafter, referred to as the specific saturated hydrocarbons) on the surfaces thereof.

With regard to the inorganic particles which include saturated hydrocarbons having from 9 to 35 carbon atoms on the surfaces thereof, the surfaces of the inorganic particles may be partially coated with the specific saturated hydrocarbons. However, it is preferable that 50% by area or more of the surfaces of the inorganic particles are coated with the specific saturated hydrocarbons and it is more preferable that 80% by area or more of the surfaces of the inorganic particles are coated with the specific saturated hydrocarbons. As a method of measuring the coating amount of the specific saturated hydrocarbons for example, a method is used in which the specific saturated hydrocarbons are dyed with a colorant formed of an organic compound or an aromatic compound and the average value of 50 or more inorganic particles is calculated by taking an image of the toner or the inorganic particles and analyzing the image.

In addition, the specific saturated hydrocarbons are adhereed to the surfaces of the inorganic particles. That is, the specific saturated hydrocarbons may be physically adsorbed or bonded by chemical bonds to the surfaces of the inorganic particles. However, it is preferable that the specific saturated hydrocarbons be physically adsorbed to the surfaces of the inorganic particles. According to the above-described example, even when the toner is exposed to a high-temperature and high-humidity environment for a long time, toner filming is further suppressed. In addition, in the case where the specific saturated hydrocarbons are physically adsorbed, the specific saturated hydrocarbons are partially separated or directly attached from the inorganic particles to a carrier, a photoreceptor, or the like when toner is used, thereby further suppressing toner filming.

Saturated Hydrocarbons Having from 9 to 35 Carbon Atoms

The specific saturated hydrocarbons used in the exemplary embodiment have a saturated structure without an unsaturated bond and have from 9 to 35 carbon atoms. When the number of carbon atoms is less than 9, volatility is high and treatment for the surface of the external additive is difficult. On the other hand, when the number of carbon atoms is more than 35, uniform layer formation is difficult and it is difficult to sufficiently suppress the forming of sites where electric charge is leaked due to water molecule adsorption.

The number of carbon atoms included in the specific saturated hydrocarbons is preferably from 12 to 30 and more preferably from 16 to 25.

The form of the specific saturated hydrocarbons is not particularly limited, for example, may be linear, branched, or cyclic or may be a mixture. However, the specific saturated hydrocarbons are preferably branched or linear and more preferably linear. In addition, when the specific saturated hydrocarbons have a cyclic structure, the cyclic structure is preferably 9 to 35-membered monocyclic saturated hydrocarbons.

In the exemplary embodiment, the specific saturated hydrocarbons may include saturated hydrocarbons having less than 9 carbon atoms or more than 35 carbon atoms. However, the content of saturated hydrocarbons having from 9 to 35 carbon atoms is preferably 60% by weight or more, more preferably 80% by weight or more, still more preferably 90% by weight or more, and even still more preferably 99% by weight or more.

With regard to a distribution of the number of carbon atoms included in the specific saturated hydrocarbons, it is preferable that a range of the number of carbon atoms included in the 90% by weight or more of the specific saturated hydrocarbons be less than or equal to 5. That is, it is preferable that 90% by weight or more of the specific saturated hydrocarbons having from N to N 5 (N is from 9 to 30) carbon atoms be included. A range of the number of carbon atoms included in the 90% by weight or more of the specific saturated hydrocarbons is more preferably less than or equal to 3 and still more preferably less than or equal to 2. By using the specific saturated hydrocarbons with a narrow distribution of the number of carbon atoms, a layer of the specific saturated hydrocarbons, which is formed on the surface of toner or a carrier, is uniform and the forming of a site where electric charge is leaked due to water molecule adsorption is effectively suppressed, which is preferable.

Examples of the specific saturated hydrocarbons include nonane, decane, undecane, dodecane, tridecane, tetradecane, pentadecane, hexadecane, heptadecane, octadecane, nonadecane, icosane (eicosane), henicosane, docosane, tricosane, tetracosane, pentacosane, hexacosane, heptacosane, octacosane, nonacosane, triacontane, hentriacontane, dotriacontane, and tritriacontane, which are linear, branched, or cyclic.

In addition, commercially available products such as Isopar-M (manufactured by Exxon Mobil Corporation) may be used.

In the exemplary embodiment, a content of the saturated hydrocarbons is preferably in the range of 1% by weight to 30% by weight with respect to the total weight of the inorganic particles.

Inorganic Particles

The inorganic particles which include the specific saturated hydrocarbons on the surfaces thereof are not particularly limited and well known inorganic particles are used as an external additive of the toner, for example, particles of silica, alumina, titanium oxides (for example, titanium oxide and metatitanic acid), cerium oxide, zirconia, calcium carbonate, magnesium carbonate, calcium phosphate, and carbon black.

Among these, silica particles or titanium oxide particles are preferable and silica particles are particularly preferable.

Examples of silica particles include particles of fumed silica, colloidal silica, and silica gel.

In addition to the fact that the inorganic particles include the specific saturated hydrocarbons on the surfaces thereof, the surfaces of the inorganic particles may be treated with a silane coupling agent described below and the like, for example.

The volume average primary particle diameter of the inorganic particles is preferably from 3 nm to 500 nm, more preferably from 7 nm to 300 nm, still more preferably from 20 nm to 200 nm, and even still more preferably from 40 nm to 130 nm. In the above-described range, a transport property of the specific saturated hydrocarbons to a carrier, a photoreceptor, and the like is excellent and toner filming is further suppressed.

It is preferable that the volume average primary particle diameter of the inorganic particles be measured using an LS13-320 (manufactured by Beckman Coulter Inc.).

In addition, in the toner according to the exemplary embodiment, it is preferable that the volume average primary particle diameter of the inorganic particles, which include the specific saturated hydrocarbons on the surfaces thereof, be greater than that of other external additives except the inorganic particles.

In the toner according to the exemplary embodiment, the content of the inorganic particles which include the specific saturated hydrocarbons on the surfaces thereof is not particularly limited but is preferably from 0.3% by weight to 10% by weight, more preferably from 0.5% by weight to 5% by weight, and still more preferably from 0.8% by weight to 2.0% by weight, with respect to the total weight of the toner.

Preparation Method of Inorganic Particles Including Specific Saturated Hydrocarbons on Surfaces Thereof (Surface Treatment Method)

The preparation method of the inorganic particles including the specific saturated hydrocarbons on the surfaces thereof is not particularly limited and well-known methods are used. In addition, a chemical process is not necessarily performed. Even when saturated hydrocarbons are physically adsorbed to the surfaces of the inorganic particles, an effect of the present invention is exhibited sufficiently.

Examples of the physical adsorption method include a dry method such as a spray dry method in which the specific saturated hydrocarbons or a solution containing the specific saturated hydrocarbons is sprayed on inorganic particles floating in the gas phase and a method in which inorganic particles are dipped in a solution containing the specific saturated hydrocarbons and dried. In addition, the specific saturated hydrocarbons on the surfaces of the inorganic particles may be chemically treated by heating the inorganic particles subjected to the physical adsorption.

In the toner according to the exemplary embodiment, the amount of inorganic particles treated with the specific saturated hydrocarbons (the content of the specific saturated hydrocarbons in the toner) is preferably equal to or greater than 0.10% by weight and more preferably equal to or greater than 0.20% by weight; and preferably less than or equal to 5.5% by weight, more preferably less than or equal to 2.0% by weight, and still more preferably less than or equal to 0.50% by weight with respect to the total weight of the toner. In the above-described range, an effect of suppressing toner filming is further exhibited.

As a method of externally adding the external additive to the toner according to the exemplary embodiment, for example, a method is used in which toner particles and external additives are mixed using a Henschel mixer or a V blender. In addition, when the toner particles are prepared in a wet method, the external additive may be externally added in a wet method.

In addition, for example, a method is used in which the inorganic particles are externally added to the toner particles, the specific saturated hydrocarbons or a solution containing the specific saturated hydrocarbons is added thereto, and the resultant is mixed using a Henschel mixer or a V blender.

Among these methods, the physical adsorption method is preferable as the preparation method of the inorganic particles including the specific saturated hydrocarbons on the surfaces thereof.

Other External Additives

The toner according to the exemplary embodiment may contain other external additives except the inorganic particles including the specific saturated hydrocarbons on the surfaces thereof (hereinafter, referred to as "other external additives").

The content of other external additives in the toner according to the exemplary embodiment may be less than that of the inorganic particles including the specific saturated hydrocarbons on the surfaces thereof.

Examples of other external additives include the above-described inorganic particles, resin particles of vinyl resin, polyester resin, silicone resin, and the like.

It is preferable that the surfaces of the inorganic particles used as other external additives be treated with a hydrophobizing agent. This hydrophobizing treatment is effective for improving liquidity of toner particles, dependency of electric charging on an environment, and contamination resistance of a carrier.

The hydrophobizing treatment is performed by, for example, dipping the inorganic particles in a hydrophobizing agent. The hydrophobizing agent is not particularly limited and examples thereof include a silane coupling agent, a titanate coupling agent, and an aluminum coupling agent. These hydrophobizing agents may be used alone or in a combination of two or more kinds thereof. Among these, the silane coupling agent is preferable.

As the silane coupling agent, for example, any type of chlorosilane, alkoxysilane, silazane, and a special silylating agent may be used.

Specific examples thereof include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltriethoxysilane, decyltrimethoxysilane, hexamethyldisilazane, N,O-(bistrimethylsilyl) acetamide, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, and γ-chloropropyltrimethoxysilane.

The content of the hydrophobizing agent varies depending on the kind of the inorganic particles and the like and is difficult to define indiscriminately, but is preferably from part by weight to 50 parts by weight and more preferably from 5 parts by weight to 20 parts by weight, with respect to 100 parts by weight of the inorganic particles. In the exemplary embodiment, as the hydrophobic silica particles, commercially available products are preferably used.

The average primary particle diameter of other external additives is preferably from 3 nm to 500 nm, more preferably from 5 nm to 100 nm, and still more preferably from 5 nm to 50 nm.

Toner Particles

The electrostatic charge image developing toner according to the exemplary embodiment includes toner particles containing a colorant, a binder resin, and a release agent. In addition, the toner particles further include well-known additives such as a charge-controlling agent.

Binder Resin

Examples of the binder resin include polyolefin resin such as polyethylene or polypropylene, styrene resin including polystyrene, poly(α-methylstyrene) or the like as a major component, (meth)acrylic resin including polymethyl methacrylate, polyacrylonitrile or the like as a major component, styrene-(meth)acrylic copolymer resin, polyamide resin, polycarbonate resin, polyether resin, polyester resin, and a copolymer resin thereof. However, from the viewpoints of charging stability and development durability when used for the electrostatic charge image developing toner, styrene resin, (meth)acrylic resin, styrene-(meth)acrylic copolymer resin, and polyester resin are preferable.

As the binder resin, from the viewpoint of low-temperature fixing property, polyester resin is preferably contained and amorphous (noncrystalline)polyester resin is more preferably contained.

Polyester resin is obtained, for example, by polycondensation of polyvalent carboxylic acids and polyols.

Examples of polyvalent carboxylic acids include aromatic carboxylic acids such as terephthalic acid, isophthalic acid, phthalic anhydride, trimellitic anhydride, pyromellitic acid, and naphthalenedicarboxylic acid; aliphatic carboxylic acids such as maleic anhydride, fumaric acid, succinic acid, alkenyl succinic anhydride, and adipic acid; alicyclic carboxylic acids such as cyclohexanedicarboxylic acid; and lower alkyl esters and acid anhydrides thereof. Lower alkyl represents a linear, branched, or cyclic alkyl group having from 1 to 8 carbon atoms. These polyvalent carboxylic acids are used alone or in a combination of two or more kinds thereof. Among these polyvalent carboxylic acids, aromatic carboxylic acids are preferable. In addition, in order to adopt a cross-linked structure or a branched structure for securing an excellent fixing property, it is preferable that a dicarboxylic acid be used in combination with a trivalent or higher carboxylic acid (for example, trimellitic acid and acid anhydride thereof).

Examples of polyvalent carboxylic acids used for obtaining amorphous polyester resin include aromatic dicarboxylic acids such as phthalic acid, isophthalic acid, terephthalic acid, naphthalene-2,6-dicarboxylic acid, 1,4-phenylenediacetic acid, and 1,4-cyclohexanedicarboxylic acid; dicarboxylic acids having an alicyclic hydrocarbon group; and acid anhydrides and lower alkyl esters thereof.

Examples of polyols include aliphatic dials such as ethylene glycol, diethylene glycol, triethylene glycol, propylene glycol, butanediol, hexanediol, neopentyl glycol, and glycerin; alicyclic diols such as cyclohexanediol, cyclohexanedimethanol, and hydrogenated bisphenol A; and aromatic dials such as ethylene oxide adducts of bisphenol A and propylene oxide adducts of bisphenol A. These polyols may be used alone or in a combination of two or more kinds thereof.

As polyols used for obtaining amorphous polyester, for example, aliphatic, alicyclic, and aromatic polyols are preferable, and specific examples thereof include 1,4-cyclohexanediol, 1,4-cyclohexanedimethanol, alkylene oxide adducts of bisphenol A, alkylene oxide adducts of bisphenol Z, and alkylene oxide adducts of hydrogenated bisphenol A. Among these, alkylene oxide adducts of bisphenol A are preferably used, and ethylene oxide 2 mol adduct of bisphenol A and propylene oxide 2 mol adduct of bisphenol A are more preferably used.

In addition, in order to adopt a cross-linked structure or a branched structure for obtaining a further excellent fixing property, it is preferable that dials be used in combination with trivalent or higher alcohols (for example, glycerin, trimethylolpropane, and pentaerythritol)

The glass transition temperature (hereinafter, may be abbreviated as "Tg") of amorphous polyester resin is preferably from 50° C. to 80° C. and more preferably from 50° C. to 70° C. When Tg is lower than or equal to 80° C., a low-temperature fixing property is excellent, which is preferable. In addition, when Tg is equal to or higher than 50° C., heat-resistant preservability is excellent and the preservability of a fixed image is also is excellent, which is preferable.

The acid value of amorphous polyester resin is preferably from 5 mg KOH/g to 25 mg KOH/g and more preferably from 6 mg KOH/g to 23 mg KOH/g. When the acid value is equal to or greater than 5 mg KOH/g, the affinity of toner for paper and a charging property are excellent. In addition, when the toner is prepared using an emulsion aggregation method described below, emulsified particles are easily prepared, the aggregation speed of an aggregation process and the speed of change of shape in a coalescence process in the emulsion aggregation are suppressed from significantly increasing, thereby making a particle size control and shape control easy. In addition, when the acid value of amorphous polyester resin is less than or equal to 25 mg KOH/g, there is no adverse effect on dependency of electric charging on an environment. In addition, when toner is prepared in the emulsion aggregation, the aggregation speed of the aggregation process and the speed of change of shape in the coalescence process are suppressed from significantly decreasing, thereby preventing deterioration in productivity.

When the molecular weight of a tetrahydrofuran (THF)-soluble matter of amorphous polyester resin is measured using a gel permeation chromatography (GPC) method, the weight average molecular weight (Mw) is preferably from 5,000 to 1,000,000 and more preferably from 7,000 to 500,000; the number average molecular weight (Mn) is from 2,000 to 100,000; and the molecular weight distribution Mw/Mn is preferably from 1.5 to 100 and more preferably from 2 to 60.

When the molecular weight and the molecular weight distribution of amorphous polyester resin are in the above-described ranges, a low-temperature fixing property does not deteriorate and the fix level of an image is excellent, which is preferable.

In the exemplary embodiment, the toner particles may contain crystalline polyester resin.

Crystalline polyester resin exhibits compatibility with amorphous polyester resin upon melting and thereby toner viscosity deteriorates significantly. As a result, a toner having a further excellent low-temperature fixing property may be obtained. Among crystalline polyester resins, the melting points of most crystalline aromatic polyester resins are generally higher than a melting temperature range described below. Therefore, when crystalline polyester resin is included, crystalline aliphatic polyester resin is more preferable.

In the exemplary embodiment, the content of crystalline polyester resin in the toner particles is preferably from 2% by weight to 30% by weight and more preferably from 4% by weight to 25% by weight. When the content is equal to or greater than 2% by weight, the viscosity of amorphous polyester resin may be reduced when melted, thereby improving a low-temperature fixing property. When the content is less than or equal to 30% by weight, deterioration of the charging property of toner, which is caused by the presence of crystalline polyester resin, is prevented and furthermore, after an image is fixed onto a recording medium, a high fix level of the image is easily obtained.

The melting temperature of crystalline polyester resin is preferably in the range of 50° C. to 90° C., more preferably in the range of 55° C. to 90° C., and still more preferably in the range of 60° C. to 90° C. When the melting temperature is equal to or higher than 50° C., toner preservability and the preservability of a fixed toner image are excellent. When the melting temperature is lower than or equal to 90° C., a low-temperature fixing property is improved.

The glass transition temperature (Tg) of amorphous polyester resin is preferably equal to or higher than 30° C., more preferably from 30° C. to 100° C., and still more preferably from 50° C. to 80° C. In the above-described range, since amorphous polyester resin is used in a glass state, the toner particles are not aggregated by heat or pressure applied during image formation and are not attached and deposited in an image forming apparatus. As a result, a stable image forming function may be obtained over a long period of time.

The glass transition temperature of resin may be measured using well-known methods, for example, a method defined by ASTM D3418-82 (DSC method).

The melting temperature of crystalline resin is measured using differential scanning calorimeter (DSC) and can be obtained as a melting peak temperature when the measurement is performed using input compensation differential scanning calorimetry shown in JIS K-7121 while the temperature is raised from room temperature to 150° C. at a rate of temperature increase of 10° C./min.

"The crystallinity" of crystalline resin represents that a clear endothermic peak is shown in the differential scanning calorimetry (DSC), not a stepwise endothermic change, and specifically represents that the half width of an endothermic peak when measured at a rate of temperature increase of 10° C./min is within 15° C.

On the other hand, a resin in which the half width of an endothermic peak is higher than 15° C. and a resin in which a clear endothermic peak is not shown are defined as amorphous (noncrystalline) resin. The glass transition temperature of amorphous resin is measured using a differential scanning calorimeter (DSC-50, manufactured by Shimadzu Corporation) which is equipped with an automatic tangent line processing system according to ASTM D3418. Measurement conditions are as follows.

Sample: 3 mg to 15 mg, preferably 5 mg to 10 mg

Measurement method: a sample is put into an aluminum pan and an empty aluminum pan is prepared for reference.

Temperature curve: Temperature Rise T (20° C. to 180° C., a rate of temperature increase of 10° C./min)

The glass transition temperature is measured from an endothermic curve which is measured during a temperature rise in the temperature curve.

The glass transition temperature is a temperature in which a differential value of the endothermic curve is maximum.

In addition, when crystalline polyester resin is a polymer in which other components are copolymerized with a main chain thereof and there are less than 50% by weight of other components, this copolymer is also called crystalline polyester.

As acid components used for synthesizing crystalline polyester resin, for example, various polyvalent carboxylic acids are used, but dicarboxylic acids are preferable and linear aliphatic dicarboxylic acids are more preferable.

Examples thereof include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicraboxylic acid, 1,14-tetradecanedicarboxylic acid, 1,16-hexadecanedicarboxylic acid, 1,18-octadecanedicarboxylic acid, and lower alkyl esters and acid anhydrides thereof. However, the acid components are not limited to these examples. Among these, adipic acid, sebacic acid, and 1,10-decanedicarboxylic acid are preferable in consideration of availability.

In addition, as the acid components used for synthesizing crystalline polyester resin, dicarboxylic acids having an ethylenic unsaturated bond and dicarboxylic acids having a sulfonic acid group may be used.

As alcohol components used for synthesizing crystalline polyester resin, aliphatic diols are preferable, and examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol, and 1,20-eicosanediol. However, the alcohol components are not limited to these examples. Among these, 1,4-butanediol, 1,6-hexanediol, 1,8-octanediol, 1,9-nonanediol, and 1,10-decanediol are preferable in consideration of availability and cost.

The molecular weight (weight average molecular weight, Mw) of crystalline polyester resin is preferably from 8,000 to 40,000 and more preferably from 10,000 to 30,000, from the viewpoints of resin preparation, particle dispersion during toner preparation, and compatibility during melting. When the weight average molecular weight is equal to or greater than 8,000, the reduction in the resistance of crystalline polyester resin is suppressed, thereby preventing deterioration in charging property. In addition, when the weight average molecular weight is less than or equal to 40,000, a cost for synthesizing resin is suppressed and deterioration of a sharp melting property is prevented. As a result, there is no adverse effect on a low-temperature fixing property.

In the exemplary embodiment, the molecular weight of polyester resin is measured and calculated using GPC (Gel Permeation Chromatography). Specifically, an HLC-8120 (manufactured by TOSOH CORPORATION) is used as the GPC, a TSK gel Super HM-M (15 cm, manufactured by TOSOH CORPORATION) is used as a column, and polyester resin is measured in a THF solvent. Next, the molecular weight of polyester resin is calculated using a molecular weight calibration curve prepared from monodispersed polystyrene standard samples.

The preparation method of polyester resin is not particularly limited and a general polyester polymerization method in which acid components and alcohol components are caused to react with each other may be used. For example, a direct polycondensation method, an ester exchange method, and the like are used depending on the kinds of monomers. The mole ratio (acid components/alcohol components) when the acid components and the alcohol components are caused to react with each other varies depending on reaction conditions and the like and thus is difficult to define indiscriminately, but is preferably about 1/1 in general in order to obtain a high molecular weight.

Examples of a catalyst which may be used during polyester resin preparation include a compound of an alkali metal such as sodium or lithium; a compound of an alkaline earth metal such as magnesium or calcium; a compound of metals such as zinc, manganese, antimony, titanium, tin, zirconium, or germanium; a phosphite compound; a phosphate compound; and an amine compound.

Styrene resin and (meth)acrylic resin, and in particular, styrene-(meth)acrylic copolymer resin may be useful as the binder resin in the present invention.

A monomer mixture, which is obtained by mixing 60 parts by weight to 90 parts by weight of vinyl aromatic monomer (styrene monomer), 10 parts by weight to 40 parts by weight of ethylenically unsaturated carboxylic acid ester monomer ((meth)acrylic acid ester monomer), and 1 part by weight to 3 parts by weight of ethylenically unsaturated acid monomer, is polymerized to obtain a copolymer, and a latex in which the obtained copolymer is dispersed and stabilized by a surfactant is preferably used as a binder resin component.

The glass transition temperature of the above copolymer is preferably from 50° C. to 70° C.

Hereinafter, polymerizable monomers constituting the above copolymer resin will be described.

Examples of styrene monomer include styrene; α-methylstyrene; vinylnaphthalene; alkyl-substituted styrene having an alkyl chain such as 2-methylstyrene, 3-methylstyrene, 4-methylstyrene, 2-ethylstyrene, 3-ethylstyrene, or 4-ethylstyrene; halogen-substituted styrene such as 2-chlorostyrene, 3-chlorostyrene, or 4-chlorostyrene; fluorine-substituted styrene such as 4-fluorostyrene or 2,5-difluorostyrene. Among these, styrene is preferable as the styrene monomer.

Examples of (meth)acrylic acid ester monomer include n-methyl(meth)acrylate, n-ethyl(meth)acrylate, n-propyl (meth)acrylate, n-butyl(meth)acrylate, n-pentyl(meth)acrylate, n-hexyl(meth)acrylate, n-heptyl(meth)acrylate, n-octyl (meth)acrylate, n-decyl(meth)acrylate, n-dodecyl(meth) acrylate, n-lauryl(meth)acrylate, n-tetradecyl(meth)acrylate, n-hexadecyl(meth)acrylate, n-octadecyl(meth)acrylate, isopropyl(meth)acrylate, isobutyl(meth)acrylate, t-butyl(meth) acrylate, isopentyl(meth)acrylate, amyl(meth)acrylate, neopentyl(meth)acrylate, isobutyl(meth)acrylate, isoheptyl (meth)acrylate, isooctyl(meth)acrylate, 2-ethylhexyl(meth) acrylate, phenyl(meth)acrylate, biphenyl(meth)acrylate, diphenylethyl(meth)acrylate, t-butylphenyl(meth)acrylate, terphenyl(meth)acrylate, cyclohexyl(meth)acrylate, t-butylcyclohexyl(meth)acrylate, dimethylaminoethyl(meth)acrylate, diethylaminoethyl(meth)acrylate, methoxyethyl(meth)acrylate, 2-hydroxyethyl(meth)acrylate, β-carboxyethyl(meth)acrylate, (meth)acrylonitrile, and (meth)acrylamide. Among these, n-butyl acrylate is preferable as the (meth)acrylic acid ester monomer.

The ethylenically unsaturated acid monomer contains a carboxylic group, a sulfonate group, and an acid group such as acid anhydride.

Styrene resin, (meth)acrylic resin or styrene-(meth)acrylic copolymer resin that contains a carboxylic group, is obtained by copolymerization of a polymerizable monomer having a carboxylic group.

Specific examples of such a polymerizable monomer having a carboxylic group include acrylic acid, aconitic acid, atropic acid, allylmalonic acid, angelic acid, isocrotonic acid, itaconic acid, 10-undecenoic acid, elaidic acid, erucic acid, oleic acid, o-carboxycinnamic acid, crotonic acid, chloroacrylic acid, chloroisocrotonic acid, chlorocrotonic acid, chlorofumaric acid, chloromaleic acid, cinnamic acid, cyclohexenedicarboxylic acid, citraconic acid, hydroxycinnamic acid, dihydroxycinnamic acid, tiglic acid, nitrocinnamic acid, vinylacetic acid, phenylcinnamic acid, 4-phenyl-3-butenoic acid, ferulic acid, fumaric acid, brassidic acid, 2-(2-furyl)acrylic acid, bromocinnamic acid, bromofumaric acid, bromomaleic acid, benzylidenemalonic acid, benzoylacrylic acid, 4-pentenoic acid, maleic acid, mesaconic acid, methacrylic acid, methylcinnamic acid, and methoxylcinnamic acid. Among these, in order to facilitate a polymerization reaction, acrylic acid, methacrylic acid, maleic acid, cinnamic acid, and fumaric acid are preferable, and acrylic acid is more preferable.

The binder resin may use a chain-transfer agent for polymerization thereof.

The chain-transfer agent is not particularly limited, and a compound having a thiol component may be used. Specifically, alkyl mercaptans such as hexyl mercaptan, heptyl mercaptan, octyl mercaptan, nonyl mercaptan, decyl mercaptan, and dodecyl mercaptan are preferable from the viewpoints of a narrow molecular weight distribution and excellent toner preservability at high temperature.

Optionally, the binder resin may contain a cross-linking agent. As a representative example of the cross-linking agent, a polyfunctional monomer having two or more ethylenically unsaturated groups in the molecule is used.

Specific examples of such a cross-linking agent include aromatic polyvinyl compounds such as divinylbenzene, and divinylnaphthalene; polyvinyl esters of aromatic polyvalent carboxylic acid such as divinyl phthalate, divinyl isophthalate, divinyl terephthalate, divinyl homophthalate, divinyl/trivinyl trimesate, divinyl naphthalenedicarboxylate, and divinyl biphenylcarboxylate; divinyl esters of a nitrogen-containing aromatic compound such as divinyl pyridinedicarboxylate; vinyl esters of an unsaturated heterocyclic compound carboxylic acid such as vinyl pyrromucinate, vinyl furancarboxylate, vinyl pyrrol-2-carboxylate, and vinyl thiophenecarboxylate; (meth)acrylate esters of linear polyols such as butanediol methacrylate, hexanediol acrylate, octanediol methacrylate, decanediol acrylate, and dodecanediol methacrylate; (meth)acrylate esters of branched or substituted polyols such as neopentyl glycol dimethacrylate and 2-hydroxy-1,3-diacryloxypropane; polyethylene glycol di(meth)acrylate and polypropylene polyethylene glycol di(meth)acrylate; and polyvinyl esters of polyvalent carboxylic acid such as divinyl succinate, divinyl fumarate, vinyl/divinyl maleate, divinyl diglycolate, vinyl/divinyl itaconate, divinyl acetonedicarboxylate, divinyl glutarate, divinyl 3,3'-thiodipropionate, divinyl/trivinyl trans-aconitate, divinyl adipate, divinyl pimelate, divinyl suberate, divinyl azelate, divinyl sebacate, divinyl dodecanedioate, and divinyl brassylate.

In the exemplary embodiment, these cross-linking agents may be used alone or in a combination of two or more kinds thereof.

The content of the cross-linking agent is preferably in the range of 0.05% by weight to 5% by weight and more preferably in the range of 0.1% by weight to 1.0% by weight, with respect to the total weight of polymerizable monomer.

Among the binder resins, a resin which may be prepared by radical polymerization of polymerizable monomers may be polymerized using a radical polymerization initiator.

The radical polymerization initiator is not particularly limited. Specific examples thereof include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethyl benzoyl peroxide, lauroyl peroxide, ammonium persulfate, sodium persulfate, potassium persulfate, diisopropyl peroxycarbonate, tetralin hydroperoxide, 1-phenyl-2-methyl propyl-1-hydroperoxide, tert-butyl triphenyl peracetate hydroperoxide, tert-butyl performate, tert-butyl peracetate, tert-butyl perbenzoate, tert-butyl phenyl peracetate, tert-butyl methoxy peraceate, and tert-butyl N-(3-toluoyl)percarbamate; azo compounds such as 2,2'-azobispropane, 2,2'-dichloro-2,2'-azobispropane, 1,1'-azo(methylethyl)diacetate, 2,2'-azobis(2-amidinopropane)hydrochloride, 2,2'-azobis(2-amidinopropane)nitrate, 2,2'-azobisisobutane, 2,2'-azobisisobutylamide, 2,2'-azobisisobutyronitrile, methyl 2,2'-azobis-2-methyl propionate, 2,2'-dichloro-2,2'-azobisbutane, 2,2'-azobis-2-methyl butyronitrile, dimethyl 2,2'-azobisisobutyrate, 1,1'-azobis(sodium 1-methyl butyronitrile-3-sulfonate), 2-(4-methyl phenylazo)-2-methyl malonodinitrile, 4,4'-azobis-4-cyanovalerate, 3,5-dihydroxymethyl phenylazo-2-methyl malonodinitrile, 2-(4-bromophenylazo)-2-allyl malonodinitrile, 2,2'-azobis-2-methyl valeronitrile, dimethyl 4,4'-azobis-4-cyanovalerate, 2,2'-azobis-2,4-dimethyl valeronitrile, 1,1'-azobiscyclohexane nitrile, 2,2'-azobis-2-propyl butyronitrile, 1,1'-azobis-1-chlorophenyl ethane, 1,1'-azobis-1-cyclohexane carbonitrile, 1,1'-azobis-1-cycloheptane nitrile, 1,1'-azobis-1-phenyl ethane, 1,1'-azobiscumene, ethyl 4-nitrophenylazobenzyl cyanoacetate, phenylazodiphenyl methane, phenylazotriphenyl methane, 4-nitrophenylazotriphenyl methane, 1,1'-azobis-1,2-diphenyl ethane, poly(bisphenol A-4,4'-azobis-4-cyanopentanoate), and poly(tetraethylene glycol-2,2'-azobisisobutyrate); 1,4-bis(pentaethylene)-2-tetrazene and 1,4-dimethoxycarbonyl-1,4-diphenyl-2-tetrazene.

In addition, examples of crystalline vinyl resin include vinyl resins which are prepared from esters of (meth)acrylic acid having a long chain alkyl or alkenyl such as amyl(meth)acrylate, hexyl(meth)acrylate, heptyl(meth)acrylate, octyl(meth)acrylate, nonyl(meth)acrylate, decyl(meth)acrylate, undecyl(meth)acrylate, tridecyl(meth)acrylate, myristyl(meth)acrylate, cetyl(meth)acrylate, stearyl(meth)acrylate, oleyl(meth)acrylate, and behenyl(meth)acrylate. In this specification, "(meth)acryl" represents any one of "acyrl" and "methacryl" or both of them.

In addition, the weight average molecular weight of an addition polymerization resin such as styrene resin and (meth)acrylic resin is preferably from 5,000 to 50,000 and more preferably from 7,000 to 35,000. When the weight average molecular weight is equal to or greater than 5,000, cohesive force in the binder resin is excellent and a hot-offset property does not deteriorate. In addition, when the weight average molecular weight is less than or equal to 50,000, an excellent hot-offset property and minimum fixing temperature may be obtained. In addition, a time and a temperature required for polycondensation is appropriate and preparation efficiency is excellent.

In this case, the weight average molecular weight of the binder resin can be measured using, for example, gel permeation chromatography (GPC).

The content of the binder resin in the toner according to the exemplary embodiment is not particularly limited, but is preferably from 10% by weight to 95% by weight, more preferably from 25% by weight to 90% by weight, and still more preferably from 45% by weight to 85% by weight, with respect to the total weight of the toner. In the above-described range, a fixing property, a charging property, and the like are excellent.

Colorant

The toner particles contain a colorant.

Examples of the colorant used for the toner according to the exemplary embodiment include magnetic powder such as magnetite or ferrite; various pigments such as Carbon Black, Lamp Black, Chrome Yellow, Hansa Yellow, Benzidine Yellow, Threne Yellow, Quinoline Yellow, Permanent Orange GTR, Pyrazolone Orange, Vulkan Orange, Watchyoung Red, Permanent Red, Brilliant Carmine 3B, Brilliant Carmine 6B, Du Pont Oil Red, Pyrazolone Red, Lithol Red, Rhodamine B Lake, Lake Red C, Rose Bengal, Aniline Blue, Ultramarine Blue, Calco Oil Blue, Methylene Blue Chloride, Phthalocyanine Blue, Phthalocyanine Green, and Malachite Green Oxalate; and various dyes of acridine, xanthene, azo, benzoquinone, azine, anthraquinone, thioindigo, dioxadine, thiazine, azomethine, indigo, phthalocyanine, aniline black, polymethine, triphenylmethane, diphenylmethane, and thiazole. These examples may be used alone or in a combination of two or more kinds thereof.

Furthermore, for example, C.I. Pigment Red 48:1, C.I. Pigment Red 122, C.I. Pigment Red 57:1, C.I. Pigment Yellow 97, C.I. Pigment Yellow 17, C.I. Pigment Blue 15:1, and C.I. Pigment Blue 15:3 are also used.

The content of the colorant in the toner particles is preferably from 1 part by weight to 30 parts by weight with respect to 100 parts by weight of the binder resin included in the toner particles. In addition, optionally, use of a surface-treated colorant or a pigment dispersant may be effective. By appropriately selecting the kind of the colorant, various color toners such as yellow toner, magenta toner, cyan toner, and black toner can be obtained.

Release Agent

The toner particles contain a release agent.

The release agent used in the exemplary embodiment is not particularly limited. Well-known release agents are used and waxes below are preferable.

Examples thereof include paraffin wax and derivatives thereof, montan wax and derivatives thereof, microcrystalline wax and derivatives thereof, Fischer-Tropsch wax and derivatives thereof, and polyolefin wax and derivatives thereof. The derivatives include polymers with oxide or vinyl monomers; and graft-modified products. As other examples, alcohol, fatty acid, plant wax, animal wax, mineral wax, ester wax, acid amide and the like are also used.

The wax used as the release agent has a melting temperature of preferably from 70° C. to 140° C. and a melt viscosity of preferably from 1 centipoise to 200 centipoise and more preferably 1 centipoise to 100 centipoise. When the melting point is equal to or higher than 70° C., the change temperature of wax is sufficiently high. Therefore, blocking resistance and developability when a temperature in a copying machine is high are excellent. When the melting point is lower than or equal to 140° C., the change temperature of wax is sufficiently low. Therefore, it is not necessary to perform fixing at high temperature and power-saving characteristics are excellent. In addition, when the melt viscosity is less than or equal to 200 centipoise, elution from toner is appropriate, fixing and releasing properties are excellent.

In the toner according to the exemplary embodiment, the release agent is selected from the viewpoints of a fixing property, a toner blocking property, toner strength, and the like. The addition amount of the release agent is not particularly limited but is preferably in the range of 2 parts by weight to 20 parts by weight with respect to 100 parts by weight of the binder resin included in the toner particles.

Other Additives

Optionally, the toner particles may further include various components such as an internal additive or a charge-controlling agent, in addition to the above-described components.

Examples of the internal additive include metals such as ferrite, magnetite, reduced iron, cobalt, nickel, or manganese, alloys thereof, and magnetic materials such as compounds including the above-described metals.

Examples of the charge-controlling agent include a quaternary ammonium salt compound, a nigrosine compound, a dye formed of a complex of aluminum, iron and chromium, and triphenylmethane pigment.

The preparation method of the toner particles used in the exemplary embodiment is not particularly limited and well-known methods can be used. Specific examples of the preparation method of the toner particles are as follows: a kneading and pulverizing method in which the binder resin, the colorant, and the release agent (and optionally, the charge-controlling agent and the like) are kneaded, pulverized, and classified; a method in which shapes of particles obtained using the kneading and pulverizing method are changed by mechanical shock or heat energy; an emulsion aggregation method in which a dispersion having the binder resin emulsified and dispersed therein and a dispersion having the colorant and the release agent (and optionally, the charge-controlling agent and the like) are mixed, aggregated, heated, and coalesced to obtain toner particles; an emulsion polymerization aggregation method in which a dispersion obtained by emulsifying and polymerizing a polymerizable monomer of the binder resin, the colorant, and the release agent (and optionally, the charge-controlling agent and the like) are mixed, aggregated, heated, and coalesced to obtain toner particles; a suspension polymerization method in which a polymerizable monomer for obtaining the binder resin and a solution having the colorant, and the release agent (and optionally, the charge-controlling agent and the like) are suspended in an aqueous solvent and polymerized; and a dissolving suspension method in which the binder resin and a solution having the colorant, and the release agent (and optionally, the charge-controlling agent and the like) are suspended in an aqueous solvent for granulation. In addition, a preparation method may be used in which the toner particles obtained in the above method are used as a core and furthermore aggregated particles are attached, heated, and coalesced to have a core-shell structure.

Among these, it is preferable that the toner according to the exemplary embodiment be toner (emulsion aggregation toner) obtained in the emulsion aggregation method or an emulsion polymerization aggregation method.

The volume average particle size of the toner particles obtained as described above is preferably in the range of 2 μm to 8 μm and more preferably in the range of 3 μm to 7 μm. When the volume average particle size is equal to or greater than 2 μm, the liquidity of the toner is excellent and sufficient charging capability is imparted from a carrier, thereby suppressing background fogging and deterioration of density reproduction. In addition, when the volume average particle size is less than or equal to 8 μm, fine dot reproduction, tone, and graininess is significantly improved, thereby obtaining a high-quality image. The volume average particle size is measured using a measuring machine such as Coulter Multisizer II (manufactured by Beckman Coulter, Inc.).

It is preferable that the toner particles have a pseudo-spherical shape from the viewpoints of improving development and transfer efficiency and high image quality. The sphericity of the toner particles is represented by the shape factor SF1 of the following expression. The average of the shape factors SF1 (average shape factor) of the toner particles used in the exemplary embodiment is preferably less than 145, more preferably equal to or greater than 115 and less than 140, and still more preferably equal to or greater than 120 and less than 140. When the average of the shape factors SF1 is less than 145, excellent transfer efficiency is obtained and image quality is high.

$$SF1 = \frac{(ML)^2}{A} \times \frac{\pi}{4} \times 100 \qquad \text{Expression 1}$$

In the above expression, ML represents the maximum lengths of the respective toner particles and A represents the projection areas of the respective toner particles.

The average of the shape factors SF1 (average shape factor) is obtained by inputting 1000 toner images magnified 250 times to an image analyzer (LUZEX III, manufactured by Nireco Corporation) through an optical microscope, calculating the SF1 values of the respective particles from the maximum lengths and projection areas thereof, and obtaining the average thereof.

Electrostatic Charge Image Developer

The electrostatic charge image developing toner according to the exemplary embodiment is preferably used as an electrostatic charge image developer.

The electrostatic charge image developer according to the exemplary embodiment is not particularly limited as long as it contains the electrostatic charge image developing toner according to the exemplary embodiment, and the configuration of components thereof is appropriately changed according to the purpose. A single-component electrostatic charge image developer is prepared when the electrostatic charge image developing toner according to the exemplary embodiment is used alone, and a two-component electrostatic charge image developer is prepared when the electrostatic charge image developing toner according to the exemplary embodiment is used in combination with a carrier.

A method is used in which as the single-component developer, toner particles are charged by performing triboelectric charging using a development sleeve or a charging member and a toner image is developed according to an electrostatic latent image.

In the exemplary embodiment, a development method is not particularly limited, but two-component development is preferable. In addition, a carrier is not particularly limited as long as the above-described conditions are satisfied. Examples of a core material of a carrier include magnetic metals such as iron, steel, nickel, or cobalt; an alloy of the above-described metal and manganese, chromium, rare-earth elements, or the like; and magnetic oxides such as ferrite or magnetite. However, from the viewpoints of surface nature and resistance of a core material, ferrite, in particular, an alloy with manganese, lithium, strontium, magnesium, or the like is preferable.

It is preferable that the surface of the core material of the carrier according to the exemplary embodiment be coated with resin. The resin is not particularly limited and is appropriately selected according to the purpose. Examples of the resin include well-known resins such as polyolefin resin such as polyethylene or polypropylene; polyvinyl resin and polyvinylidene resin such as polystyrene, acrylic resin, polyacrylonitrile, polyvinyl acetate, polyvinyl alcohol, polyvinyl butyral, polyvinyl chloride, polyvinyl carbazole, polyvinyl ether, or polyvinyl ketone; vinyl chloride-vinyl acetate copolymer; styrene-acrylic acid copolymer; straight silicone resin having an organosiloxane bond or a modified product thereof; fluororesin such as polytetrafluoroethylene, polyvinyl fluoride, polyvinylidene fluoride, or polychlorotrifluoroethylene; silicone resin; polyester; polyurethane; polycarbonate; phenol resin; amino resin such as urea formaldehyde resin, melamine resin, benzoguanamine resin, urea resin, or polyamide resin; and epoxy resin. These examples may be used alone or in a combination of two or more kinds thereof. In the exemplary embodiment, it is preferable that among these resins, at least fluororesin and/or silicone resin be used. As the resin, when at least fluororesin and/or silicone resin is used, an effect of suppressing carrier contamination (impaction) caused by toner or an external additive is high, which is preferable.

In a coating layer formed by the resin, it is preferable that resin particles and/or conductive particles be dispersed in the resin. Examples of the resin particles include thermoplastic resin particles and thermosetting resin particles. Among these, thermosetting resin particles are preferable from the viewpoint of increasing hardness relatively easily and resin particles of nitrogen-containing resin which contains a nitrogen atom are preferable from the viewpoint of imparting a negative charging property to toner. In addition, the resin particles may be used alone or in a combination of two or more kinds thereof. The average particle size of the resin particles is preferably from 0.1 μm to 2 μm and more preferably from 0.2 μm to 1 μm. When the average particle size of the resin particles is equal to or greater than 0.1 μm, the dispersibility of the resin particles in the coating layer is excellent. In addition, when the average particle size of the resin particles is less than or equal to 2 μm, it is difficult that the resin particles be desorbed from the coating layer.

Examples of the conductive particles include metal particles such as particles of gold, silver, or copper; carbon black particles; and particles of titanium oxide, zinc oxide, barium sulfate, aluminum borate, potassium titanate or the like with the surfaces coated with tin oxide, carbon black, metal, or the like. The conductive particles are used alone or in a combination of two or more kinds thereof. Among these, carbon black particles are preferable from high preparation stability, low cost, and high conductivity. The kind of carbon black is not particularly limited, but carbon black having a DBP oil absorption of 50 ml/100 g to 250 ml/100 g is preferable due to its excellent preparation stability. The amount of the resin, the resin particles, and the conductive particles which coat the surface of the core material is preferably from 0.5% by weight to 5.0% by weight and more preferably from 0.7% by weight to 3.0% by weight.

A method of forming the coating layer is not particularly limited. For example, there may be used a method of preparing a coating layer-forming solution which contains the resin particles such as cross-linked resin particles and/or the conductive particles; and the resin such as styrene acrylic resin, fluororesin, silicone resin or the like which is matrix resin in a solvent.

Specific examples thereof include a dipping method in which the core material of the carrier is dipped in the coating layer-forming solution, a spray method in which the coating layer-forming solution is sprayed on the surface of the core material of the carrier, and a kneader coater method in which the core material of the carrier and the coating layer-forming solution are mixed in a state where the core material is floated by flowing air and a solvent is removed. Among these, in the exemplary embodiment, the kneader coater method is preferable.

The solvent used for the coating layer-forming solution is not particularly limited as long as only the resin which is matrix resin may be dissolved therein. The solvent is selected from well-known solvents, and examples thereof include aromatic hydrocarbons such as toluene or xylene; ketones such as acetone or methyl ethyl ketone; and ethers such as tetrahydrofuran or dioxane. When the resin particles are dispersed in the coating layer, the resin particles and the resin which is matrix resin are uniformly dispersed in a thickness direction thereof and in a circumferential direction of the carrier surface. Accordingly, even if the carrier is used over a long period of time and the coating layer is abraded, the same surface as that before use is maintained all the time and an excellent charge-imparting property for the toner is maintained over a long period of time. When the conductive particles are dispersed in the coating layer, the conductive particles and the resin which is matrix resin are uniformly dispersed in a thickness direction thereof and in a circumferential direction of the carrier surface. Accordingly, even if the carrier is used over a long period of time and the coating layer is abraded, the same surface as that before use is maintained all the time and deterioration of the carrier is prevented over a long period of time. In addition, when the resin particles and the conductive particles are dispersed in the coating layer, the same effects as above are exhibited at the same time.

The electrical resistance of the entire magnetic carrier formed as above in a magnetic brush state under an electric field of $10^4$V/cm is preferably from $10^8$ Ωcm to $10^{13}$ Ωcm. When the electrical resistance of the magnetic carrier is equal to or greater than $10^8$ Ωcm, the attachment of the carrier to an image portion on an image holding member is suppressed and a brush mark is barely formed. On the other hand, when the electrical resistance of the magnetic carrier is less than or equal to $10^{13}$ Ωcm, the occurrence of an edge effect is suppressed and thus a high-quality image may be obtained.

In this case, the electrical resistance (volume resistivity) is measured as follows.

On a lower pole plate of measurement equipment which is a pair of circular polar plates having a size of 20 $cm^2$ (made of steel) which are connected to an electrometer (trade name: KEITHLEY 6100, manufactured by Keithley Instruments Inc.) and a high voltage power supply (trade name: FLUKE 415B, manufactured by Fluke Corporation), samples are placed to form an approximately 1 mm to 3 mm-thick flat layer. Next, an upper pole plate is placed on the samples and a 4 kg weight is placed on the upper pole plate in order to eliminate the gap between the samples. In this state, the thickness of the sample layer is measured. Next, an electric current value is measured by applying voltage to both of the pole plates and the volume resistivity is calculated according to the following expression.

Volume Resistivity=Applied Voltage×20÷(Current Value−Initial Current Value)÷Sample Thickness In the expression above, Initial Current Value represents a current value when the applied voltage is 0 and Current Value represents a measured current value.

With regard to the mixing ratio of the toner and the carrier according to the exemplary embodiment in the two-component electrostatic charge image developer, the amount of the toner is preferably 2 parts by weight to 10 parts by weight with respect to the 100 parts by weight of the carrier. In addition, the preparation method of the developer is not particularly limited, and, for example, a method of mixing the components using a V-blender or the like is used.

Image Forming Method

In addition, the electrostatic charge image developer (toner for developing an electrostatic charge image) is used for an image forming method for electrostatic charge image development (electrophotography).

The image forming method according to the exemplary embodiment includes a charging process of charging a surface of an image holding member; a latent image forming process of forming an electrostatic latent image on the surface of the image holding member; a developing process of forming a toner image by developing the electrostatic latent image, which is formed on the surface of the image holding member, using a developer including a toner; and a transfer process of transferring the toner image onto the surface of a transfer medium, and optionally may further include a fixing process of fixing the toner image transferred onto the surface of transfer medium; and a cleaning process of cleaning an electrostatic charge image developer which remains on the image holding member. In this method, as the developer, the electrostatic charge image developing toner according to the exemplary embodiment or the electrostatic charge image developer according to the exemplary embodiment may be used.

The respective processes are well-known general processes and disclosed in, for example, JP-A-56-40868 and JP-A-49-91231. The image forming method according to the exemplary embodiment may be performed using well-known image forming apparatuses such as copying machines and fax machines.

In the latent image forming process, an electrostatic latent image is formed on the image holding member (photoreceptor).

In the developing process, the electrostatic latent image is developed by a developer layer on a developer holding member and thus a toner image is formed. The developer layer is not particularly limited as long as it contains the electrostatic charge image developing toner according to the exemplary embodiment.

In the transfer process, the toner image is transferred onto a transfer medium. In addition, as the transfer medium in the transfer process, for example, an intermediate transfer medium and a recording medium such as paper are used.

In the fixing process, for example, there is used a method of fixing a toner image, which is transferred onto transfer paper, using a heating roller fixing device in which the temperature of a heating roller is set to be constant, and forming a duplicate image.

In the cleaning process, a developer remaining on the image holding member is cleaned.

In addition, in the cleaning process of the image forming method according to the exemplary embodiment, it is preferable that an electrostatic charge image developer remaining on the image holding member be removed by a cleaning blade.

As the recording medium, well-known recording media such as paper or OHP sheets which are used for electrophotographic copying machines or printers are used, and preferable examples thereof include coated paper in which the surface of plain paper is coated with resin or the like and art paper for printing.

The image forming method according to the exemplary embodiment may further include a recycling process. In the recycling process, the electrostatic charge image developing toner, which is collected in the cleaning process, is transferred to the developer layer. The image forming method including the recycling process is performed using an image forming apparatus such as toner recycling system type copying machines or fax machines. In addition, a recycling system in which development and toner recovery are performed at the same time may be adopted.

Image Forming Apparatus

The image forming apparatus according to the exemplary embodiment includes a image holding member; a charging unit that charges a surface of the image holding member; a latent image forming unit that forms an electrostatic latent image on the surface of the image holding member; a developing unit that forms a toner image by developing the electrostatic latent image using a developer including a toner; and a transfer unit that transfers the toner image from the image holding member onto the surface of a transfer medium, and optionally may further include a fixing unit that fixes the toner image transferred onto the surface of the transfer medium; and a cleaning unit that cleans the image holding member. In this apparatus, as the developer, the electrostatic charge image developing toner according to the exemplary embodiment or the electrostatic charge image developer according to the exemplary embodiment may be used.

The image forming apparatus according to the exemplary embodiment is not particularly limited as long as it includes at least the image holding member, the charging unit, the exposure unit, the developing unit, the transfer unit, the fixing unit, and the cleaning unit, but optionally, may further include an erasing unit and the like.

The transfer unit may perform transfer twice or more using an intermediate transfer medium. In addition, as the transfer medium of the transfer unit, for example, an intermediate transfer medium and a recording medium such as paper are used.

For the image holding member and the respective units, components described for the respective processes of the image forming method described above are preferably used. As the respective units, well-known units of image forming apparatuses may be used. In addition, the image forming apparatus according to the exemplary embodiment may include units or devices having components other than the above-described components. In addition, the image forming apparatus according to the exemplary embodiment may operate plural units of the above-described units at the same time.

In addition, as the cleaning unit that cleans an electrostatic charge image developer remaining on the image holding member, for example, a cleaning blade, a cleaning brush, and the like are used, but a cleaning blade is preferable.

Preferable examples of a material of the cleaning blade include urethane rubber, neoprene rubber, and silicone rubber.

Toner Cartridge, Developer Cartridge, and Process Cartridge

A toner cartridge according to the exemplary embodiment contains at least the electrostatic charge image developing toner according to the exemplary embodiment.

A developer cartridge according to the exemplary embodiment contains at least the electrostatic charge image developer according to the exemplary embodiment.

In addition, a process cartridge according to the exemplary embodiment includes the developing unit that forms a toner image by developing an electrostatic latent image, which is formed on the surface of the image holding member, using the electrostatic charge image developing toner or the electrostatic charge image developer and at least one selected from a group consisting of the image holding member, the charging unit that charges the surface of the image holding member; and the cleaning unit that removes toner remaining on the surface of the image holding member. In addition, the process cartridge contains at least the electrostatic charge image developing toner according to the exemplary embodiment or the electrostatic charge image developer according to the exemplary embodiment.

It is preferable that the toner cartridge according to the exemplary embodiment contains a toner containing chamber that accommodates the electrostatic charge image developing toner according to the exemplary embodiment and is detachable from an image forming apparatus. That is, in the image forming apparatus from which the toner cartridge is detachable, the toner cartridge according to the exemplary embodiment containing the toner according to the exemplary embodiment is preferably used.

The developer cartridge according to the exemplary embodiment is not particularly limited as long as it contains an electrostatic charge image developer containing the electrostatic charge image developing toner according to the exemplary embodiment. For example, the developer cartridge contains a developer containing chamber that accommodates the electrostatic charge image developer according to the exemplary embodiment. Further, the developer cartridge is detachable from an image forming apparatus including the developing unit and includes, as a developer which is supplied to this developing unit, the electrostatic charge image developer containing the electrostatic charge image developing toner according to the exemplary embodiment.

In addition, the developer cartridge may contain toner and a carrier. Alternatively, a cartridge containing toner alone and a cartridge containing a carrier alone may be provided separately.

It is preferable that the process cartridge according to the exemplary embodiment be detachable from an image forming apparatus.

In addition, optionally, the process cartridge according to the exemplary embodiment may further include other units such as an erasing unit.

As the toner cartridge and the process cartridge, well-known configurations may be adopted, for example, configurations disclosed in JP-A-2008-209489 and JP-A-2008-233736 may be referred to.

EXAMPLES

Hereinafter, the exemplary embodiment will be described in detail with reference to Examples, but is not limited to Examples. In the following description, "part" represents "part by weight" unless specified otherwise.

Measurement Method of Weight Average Molecular Weight and Molecular Weight Distribution of Resin The molecular weight and the molecular weight distribution of the binder resin and the like are obtained under the following conditions. "HLC-8120 GPC, SC-8020 (manufactured by TOSOH CORPORATION)" is used as GPC, two of TSK gel Super HM-M (manufactured by TOSOH CORPORATION, 6.0 mm ID×15 cm) are used as a column, and tetrahydrofuran (THF) is used as an eluent. The test is conducted using a IR detector under the following conditions: a sample concentration of 0.5%; a flow rate of 0.6 ml/min; a sample injection amount of 10 μl; and a measurement temperature of 40° C. In addition, a calibration curve is prepared from ten of "polystyrene standard samples, TSK standard": "A-500", "F-1", "F-10", "F-80", "F-380", "A-2500", "F-4", "F-40", "F-128", and F-700" (manufactured by TOSOH CORPORATION).

Volume Average Particle Size of Resin Particles and Colorant Particles and the Like The volume average particle size of the resin particles, the colorant particles, and the like are measured using a laser diffraction particle size analyzer (manufactured by HORIBA, Ltd., LA-700).

Measurement Method of Melting Temperature and Glass Transition Temperature of Resin The melting temperature of crystalline polyester resin and the glass transition temperature (Tg) of amorphous polyester resin are obtained by a subjective maximum endothermic peak which is measured using a differential scanning calorimeter (DSC-7, manufactured by PerkinElmer Inc.) in accordance with ASTM D3418-8. The temperature correction of a detection portion in this device (DSC-7) is performed using the melting temperatures of indium and zinc and the quantity of heat is corrected using the heat of fusion of indium. The samples are put in an aluminum pan and an empty pan for comparison, heated at a temperature rise rate of 10° C./min.

Measurement Method of Volume Average Particle Size of Toner Particles

The volume average particle size of the toner particles is measured using a Coulter Multisizer II (manufactured by Beckman Coulter, Inc.). ISOTON-II (manufactured by Beckman Coulter, Inc.) is used as an electrolytic solution.

As the measurement method, first, a surfactant is used as a dispersant, and preferably, 0.5 mg to 50 mg of measurement samples are added to 2 ml of 5% aqueous sodium alkylbenzene sulfonate solution. This solution is added to 100 ml to 150 ml of the electrolytic solutions. The electrolytic solutions in which the measurement samples are suspended are dispersed using an ultrasonic disperser for approximately 1 minute, the particle size distribution of 2.0 μm to 60 μm particles is measured using Coulter Multisizer II with an aperture having an aperture size of 100 μm. The number of particles measured is 50000.

The cumulative distribution of the measured particle sizes distribution from a smaller particle size side in terms of weight and volume is drawn in a divided particle size range (channel). A particle size, which is an accumulated value of 50% in the cumulative distribution, is defined as the weight average particle size and the volume average particle size.

Calculation Method of Shape Factor

The shape factor SF1 is obtained by the following expression.

$$SF1=100\pi\times(ML)^2/(4\times A)$$

In the expression, ML represents the maximum length of the toner particles and A represents the projection area of the toner particles. The maximum length and the projection area of the toner particles are obtained by observing the particles which are sampled on a glass slide through an optical microscope, inputting image data to an image analyzer (LUZEX III, manufactured by Nireco Corporation) through a video camera, and analyzing an image. At this time, the number of samples is 100 or more and, using the average value thereof, the shape factor is obtained according to the above expression.

Preparation of Toner Particles

Preparation of Respective Dispersions

Preparation of Crystalline Polyester Resin Particle Dispersion 1

260 parts of 1,12-dodecane dicarboxylic acid, 165 parts of 1,10-decanediol, and 0.035 part of tetrabutoxy titanate as a catalyst are put into a heated and dried three-necked flask, followed by reduction in the inner pressure of a vessel and reflux at 180° C. for 6 hours in an inert gas atmosphere of nitrogen gas under mechanical stirring. Then, the temperature is slowly raised to 220° C. through reduced-pressure distillation, followed by stirring for 2 and 3 hours. When the resultant is viscous, reduced-pressure distillation is stopped and air-cooling is performed. As a result, Crystalline polyester resin 1 is obtained.

The weight average molecular weight (Mw) of Crystalline polyester resin 1 obtained above is 12,000 when measured in the above-described method. In addition, the melting temperature of Crystalline polyester resin 1 obtained above is 72° C. when measured using differential scanning calorimeter (DSC) in the above-described method.

Next, 180 parts of Crystalline polyester resin 1 and 580 parts of deionized water are put into a stainless steel beaker and heated to 95° C. in a hot bath. When Crystalline polyester resin 1 is melted, stirring is performed at 8,000 rpm using a homogenizer (manufactured by TKA Japan K.K, ULTRA-TURRAX T50) and, at the same time, dilute ammonia water is added thereto to adjust the pH value to 7.0. Next, 20 parts of aqueous solution in which 0.8 part of anionic surfactant (manufactured by DAI-ICHI KOGYO SEIYAKU CO., LTD., NEOGEN R) is diluted is added dropwise, followed by emulsification and dispersion. As a result, Crystalline polyester resin particle dispersion 1 with a volume average particle size of 0.24 μm (concentration of resin particles: 12.5% by weight) is prepared.

Preparation of Amorphous Polyester Resin Particle Dispersion 1

73 parts of dimethyl adipate, 182 parts of dimethyl terephthalate, 217 parts of ethylene oxide adduct of bisphenol A, 41 parts of ethylene glycol, and 0.038 part of tetrabutoxy titanate as a catalyst are put into a heated and dried two-necked flask. Nitrogen gas is put into a vessel to maintain an inert gas atmosphere, followed by heating under stirring and a copolycondensation reaction at 160° C. for about 7 hours. Then, the resultant is heated to 220° C. and held for 3.5 hours while slowly reducing the pressure to 10 Torr ($1.33\times10^{-3}$ MPa). The pressure is temporarily returned to normal pressure, 9 parts of trimellitic anhydride is added, the pressure is slowly reduced to 10 Torr ($1.33\times10^{-3}$ MPa) again, and the resultant is held for 1 hour. As a result, Amorphous polyester resin 1 is synthesized.

In addition, the glass transition temperature of Amorphous polyester resin 1 thus obtained is 58° C. when measured using differential scanning calorimeter (DSC) in the above-described method. The weight average molecular weight (Mw) of Amorphous polyester resin 1 is 11,000 when measured using GPC in the above-described method.

Next, 115 parts of Amorphous polyester resin 1 and 180 parts of deionized water, and 5 parts of anionic surfactant (manufactured by DAI-ICHI KOGYO SEIYAKU CO., LTD., NEOGEN R) are mixed and heated to 120° C., sufficiently dispersed using a homogenizer (manufactured by IKA Japan K.K, ULTRA-TURRAX T50), followed by dispersion using a pressure discharge type Gaulin homogenizer for 1 hour. As a result, Amorphous polyester resin particle dispersion 1 (concentration of resin particles: 40% by weight) is prepared.

Preparation of Styrene-Acrylic Resin Dispersion 1

Oil Layer

Styrene (manufactured by Wako Pure Chemical Industries): 32 parts n-butyl acrylate (manufactured by Wako Pure Chemical Industries): 8 parts β-carboxyethyl acrylate (manufactured by Rhodia Niece Ltd.): 1.2 parts Dodecanthiol (manufactured by Wako Pure Chemical Industries): 0.5 part Water Layer 1

Ion exchange water: 17.0 parts

Anionic surfactant (sodium alkylbenzenesulfonate, manufactured by Rhodia): 0.50 part Water Layer 2

Ion exchange water: 40 parts

Anionic surfactant (sodium alkylbenzenesulfonate, manufactured by Rhodia): 0.06 part Ammonium persulfate (manufactured by Wako Pure Chemical Industries): 0.4 part The above components of Oil layer and Water layer 1 are put into a flask, stirred, and mixed to obtain a monomer-emulsified dispersion. The above components of Water layer 2 are put into a reaction vessel. The inside of the vessel is sufficiently substituted with nitrogen and heated in an oil bath under stirring until the temperature in the reaction system reaches 75° C.

The monomer-emulsified dispersion is slowly added dropwise into the reaction vessel over 3 hours for emulsion polymerization. After the dropwise addition, polymerization is continued at 75° C. and stopped after 3 hours. As a result, Styrene-acrylic resin dispersion 1 is obtained.

In Styrene-acrylic resin dispersion 1 thus obtained, the volume average particle size of resin particles is 330 nm and the weight average molecular weight (Mw) is 12,500 when measured using the above-described method. In addition, the glass transition temperature is 52° C. when measured using differential scanning calorimeter (DSC) in the above-described measurement method.

Preparation of Colorant Dispersion 100 parts of cyan pigment (manufactured by Dainichseika&Chemicals Mfg. Co., Ltd., Pigment Blue 15:3 (copper phthalocyanine)), 5 parts of anionic surfactant (manufactured by DAI-ICHI KOGYO SEIYAKU CO., LTD., NEOGEN R), and 300 parts of ion exchange water are mixed, dispersed for 10 minutes using a homogenizer (manufactured by IKA Japan K.K, ULTRA-TURRAX T50), and put into a circulation-type supersonic dispersing machine (manufactured by NISSEI Corporation, RUS-600 TCVP). As a result, Colorant dispersion is obtained.

In the Colorant dispersion thus obtained, the volume average particle size of the colorant (cyan pigment) is 0.17 μm when measured using a laser diffraction particle size analyzer in the above-described measurement method. In addition, the solid content of the cyan colorant dispersion is 24% by weight.

Preparation of Release Agent Dispersion 95 parts of Fischer-Tropsch wax FNP92 (melting temperature: 92° C., manufactured by NIPPON SERIO CO., LTD.), 3.6 parts of anionic surfactant (manufactured by DAI-ICHI KOGYO SEIYAKU CO., LTD., NEOGEN R), 360 parts of ion exchange water are mixed and heated to 100° C., sufficiently dispersed using a homogenizer (manufactured by IKA Japan K.K, ULTRA-TURRAX T50), followed by dispersion using a pressure discharge type Gaulin homogenizer. As a result, Release agent dispersion is obtained.

In Release agent dispersion thus obtained, the volume average particle size of the release agent is 0.24 μm when measured using a laser diffraction particle size analyzer in the above-described measurement method. In addition, the solid content of Release agent dispersion is 20% by weight.

Preparation of Toner Particles 1

104.4 parts of Crystalline polyester resin particle dispersion 1, 336.1 parts of Amorphous polyester resin particle dispersion 1, 45.4 parts of Colorant dispersion, 115.3 parts of Release agent dispersion, and 484 parts of deionized water are put into a stainless steel round flask, and sufficiently mixed and dispersed using ULTRA-TURRAX T50. Next, 0.37 part of polyaluminium chloride is added thereto and dispersion is continued using ULTRA-TURRAX T50. Furthermore, the flask is heated to 52° C. in a heating oil bath under stirring. After this state is held for 3 hours at 52° C., 175 parts of Amorphous polyester resin particle dispersion 1 is slowly added thereto. Next, the pH value of the system is adjusted to 8.5 using 0.5N aqueous sodium hydroxide solution. Then, the stainless steel flask is sealed, heated to 90° C. while stirring is continued using a magnetic seal, and held for 3 hours. After a reaction is stopped, the resultant is cooled, filtrated, sufficiently washed with ion exchange water, followed by solid-liquid separation with a Nutsche vacuum filter. The resultant is dispersed again in ion exchange water at 30° C., stirred for 15 minutes at 300 rpm, and washed. The above process is repeated five times. When the pH value of the filtrate is 6.85, the electrical conductance is 8.2 μS/cm, and the surface tension is 70.5 Nm, washing is stopped, followed by solid-liquid separation with a Nutsche vacuum filter using No. 5A filter paper and vacuum drying for 12 hours. As a result, Toner particles 1 are obtained.

The glass transition temperature of Toner Particles 1 thus obtained is 54.0° C. when measured in the above-described method. The volume average particle size of Toner Particles 1 is 5.8 μm when measured in the above-described measurement method. In addition, the average circularity of Toner Particles 1 is 0.959 when measured in the above-described measurement method.

Preparation of Toner Particles 2

Styrene-Acrylic Resin Dispersion 1: 70 parts

Colorant dispersion: 14 parts

Release agent dispersion: 22 parts

Polyaluminium chloride: 0.14 part

The above components are put into a stainless steel round flask, and sufficiently mixed and dispersed using ULTRA-TURRAX T50. Next, 0.32 part of polyaluminium chloride is added thereto and dispersion is continued using ULTRA-TURRAX T50. Furthermore, the flask is heated to 47° C. in a heating oil bath under stirring. After this state is held for 60 minutes at 47° C., 30 parts of Styrene-Acrylic Resin Dispersion 1 are slowly added thereto.

Next, the pH value of the system is adjusted to 6.0 using 0.5 mol/L of aqueous sodium hydroxide solution. Then, the stainless steel flask is sealed, heated to 96° C. while stirring is continued using a magnetic seal, and held for 3.5 hours. After a reaction is stopped, the resultant is cooled, filtrated, sufficiently washed with ion exchange water, followed by solid-liquid separation with a Nutsche vacuum filter. The resultant is dispersed again in ion exchange water at 40° C., stirred for 15 minutes at 300 rpm, and washed.

The above process is repeated five times. When the pH value of the filtrate is 7.01, the electrical conductance is 9.7 μS/cm, and the surface tension is 71.2 Nm, washing is stopped, followed by solid-liquid separation with a Nutsche vacuum filter using No. 5A filter paper and vacuum drying for 12 hours. As a result, Toner particles 2 are obtained.

The volume average particle size of Toner Particles 2 thus obtained is 5.7 μm when measured in the above-described method. In addition, the average circularity of Toner Particles 2 is 0.957 when measured in the above-described method.

Preparation of Toner Particles 3

A mixture of 100 parts of styrene-butyl acrylate copolymer (weight average molecular weight Mw=150,000, copolymerization ratio=80:20), 5 parts of carbon black (Mogul L, manufactured by Cabot Corporation), and 6 parts of carnauba wax is kneaded using an extruder and finely pulverized using a jet mill, followed by spheronization with warm air using Kryptron (manufactured by Kawasaki Heavy Industries, Ltd.) and classification using a wind classifier. As a result, Toner particles 3 having an average particle size of 6.2 μm are obtained.

Preparation of Treatment External Additive 1

10 parts of hydrophobic fumed silica R8200 (average particle size: 12 nm, manufactured by Nippon Aerosil Co., Ltd.), 0.75 part of nonane (linear, 9 carbon atoms, manufactured by TOKYO CHEMICAL INDUSTRY CO., LTD.), 1.25 parts of decane (linear, 10 carbon atoms, manufactured by TOKYO CHEMICAL INDUSTRY CO., LTD.), 0.375 part of undecane (linear, 11 carbon atoms, manufactured by TOKYO CHEMICAL INDUSTRY CO., LTD.), and 0.125 part of eicosane (linear, 20 carbon atoms, manufactured by TOKYO CHEMICAL INDUSTRY CO., LTD.) are mixed using a sample mill. As a result, Treatment external additive 1 is obtained.

Preparation of Treatment External Additive 2

10 parts of hydrophobic fumed silica R8200 (average particle size: 12 nm, manufactured by Nippon Aerosil Co., Ltd.) and 2.5 parts of eicosane (linear, 20 carbon atoms, manufactured by TOKYO CHEMICAL INDUSTRY CO., LTD.) are mixed using a sample mill. As a result, Treatment external additive 2 is obtained.

Preparation of Treatment External Additive 3

10 parts of hydrophobic fumed silica R8200 (average particle size: 12 nm, manufactured by Nippon Aerosil Co., Ltd.) and 2.5 parts of dotriacontane (linear, 32 carbon atoms, manufactured by TOKYO CHEMICAL INDUSTRY CO., LTD.) are mixed using a sample mill. As a result, Treatment external additive 3 is obtained.

Preparation of Treatment External Additive 4

10 parts of hydrophobic fumed silica R8200 (average particle size: 12 nm, manufactured by Nippon Aerosil Co., Ltd.) and 0.5 part of eicosane (linear, 20 carbon atoms, manufactured by TOKYO CHEMICAL INDUSTRY CO., LTD.) are mixed using a sample mill. As a result, Treatment external additive 4 is obtained.

Preparation of Treatment External Additive 5

10 parts of hydrophobic fumed silica 88200 (average particle size: 12 nm, manufactured by Nippon Aerosil Co., Ltd.) and 2.5 parts of Isopar-M (branched, 13 to 17 carbon atoms, manufactured by Exxon Mobil Chemical Company) are mixed using a sample mill. As a result, Treatment external additive 5 is obtained.

Preparation of Treatment External Additive 6

10 parts of hydrophobic fumed silica R8200 (average particle size: 12 nm, manufactured by Nippon Aerosil Co., Ltd.) and 2.5 parts of cyclododecane (cyclic, 12 carbon atoms, manufactured by TOKYO CHEMICAL INDUSTRY CO., LTD.) are mixed using a sample mill. As a result, Treatment external additive 6 is obtained.

Preparation of Treatment External Additive 7

10 parts of hydrophobic titanium oxide JMT-150AO (average particle size: 15 nm, manufactured by Tayca Corporation) and 2.5 parts of eicosane (linear, 20 carbon atoms, manufactured by TOKYO CHEMICAL INDUSTRY CO., LTD.) are mixed using a sample mill. As a result, Treatment external additive 7 is obtained.

Preparation of Treatment External Additive 8

10 parts of hydrophobic fumed silica R8200 (average particle size: 12 nm, manufactured by Nippon Aerosil Co., Ltd.) and 7.3 parts of eicosane (linear, 20 carbon atoms, manufactured by TOKYO CHEMICAL INDUSTRY CO., LTD.) are mixed using a sample mill. As a result, Treatment external additive 8 is obtained.

Preparation of Treatment External Additive 9

10 parts of hydrophobic fumed silica R8200 (average particle size: 12 nm, manufactured by Nippon Aerosil Co., Ltd.) 2.0 parts of eicosane (linear, 20 carbon atoms, manufactured by TOKYO CHEMICAL INDUSTRY CO., LTD.), and 0.5 part of dotriacontane (linear, 32 carbon atoms, manufactured by TOKYO CHEMICAL INDUSTRY CO., LTD.) are mixed using a sample mill. As a result, Treatment external additive 9 is obtained.

Preparation of Treatment External Additive 10

10 parts of hydrophobic fumed silica R8200 (average particle size: 12 nm, manufactured by Nippon Aerosil Co., Ltd.) and 2.5 parts of dimethyl silicone oil KF-96-50cs (manufactured by Shin-Etsu Chemical Co., Ltd.) are mixed using a sample mill. As a result, Treatment external additive 10 is obtained.

Preparation of Treatment External Additive 11

10 parts of hydrophobic fumed silica R8200 (average particle size: 12 nm, manufactured by Nippon Aerosil Co., Ltd.) and 2.5 parts of heptane (linear, 7 carbon atoms, manufactured by TOKYO CHEMICAL INDUSTRY CO., LTD.) are mixed using a sample mill. As a result, Treatment external additive 11 is obtained.

Preparation of Treatment External Additive 12

10 parts of hydrophobic fumed silica R8200 (average particle size: 12 nm, manufactured by Nippon Aerosil Co., Ltd.) and 2.5 parts of n-octatriacontane (linear, 38 carbon atoms, manufactured by TOKYO CHEMICAL INDUSTRY CO., LTD.) are mixed using a sample mill. As a result, Treatment external additive 12 is obtained.

Example 1

Preparation of External Additive-Added Toner 1

2 parts of Treatment external additive 1 is added with respect to 100 parts of Toner particles 1 and blended using a sample mill. As a result, External additive-added toner 1 is obtained.

Preparation of Developer 1

External additive-added toner 1 is added to ferrite carrier particles having a weight average particle size of 50 μm which is coated with 1% by weight of polymethyl methacrylate (manufactured by Soken Chemical&Engineering Co., Ltd) such that the toner concentration is 5% by weight, followed by stirring with a V-blender for 30 minutes and mixing. As a result, Developer 1 is prepared.

Using Developer 1 thus obtained, the following test is conducted. The results thereof are shown in Table 1.

Image Printing Test

An image printing test is conducted using an evaluation test machine (hereinafter, sometimes referred to as "the evaluation multifunction machine") which is obtained through the following processes a DocuCentre Color f450 multifunction machine (manufactured by Fuji Xerox Co., Ltd.) is modified;

the entire built-in developer is removed; and a cyan toner cartridge and a developer unit are filled with toners of Examples and Comparative Examples according to the exemplary embodiment and developers corresponding to the toners.

As printing paper, A4 size paper is used (C2 paper, manufactured by Fuji Xerox Co., Ltd.) and images are printed in an A4 transverse feed mode for the evaluation test.

For the evaluation test, 1.2 cm×17.0 cm solid images (the sides in a printing direction are the long sides) are printed as a test chart at positions which are 4 cm, 14 cm, and 23 cm distant from the upper end of A4 paper in the vertical direction of the paper.

The image density is measured using X-Rite 938 (manufactured by Nihon Heiban Kizai CO., Ltd.). A target area is measured five times and the average value thereof is obtained as the image density. Whenever 1000 images are printed, the image density is adjusted from the measurement results of the image densities of printed images such that the image density ID is from 1.25 to 1.55.

Examination of Image Quality Deterioration Due to Toner Filming and Background Fogging Due to Electric Charge Leakage The initial state of the evaluation test is as follows Under the conditions of a temperature of 22° C. and a humidity of 55%, 10,000 test charts are printed and then 10 half-tone images are printed on the entire surfaces such that the image density ID is from 0.40 to 0.60. In this case, the tenth printed image is set as an initial image sample for evaluation.

Next, the evaluation multifunction machine containing the developer and the toner is moved to an environment of a temperature of 30° C. and a humidity of 80% and held for 48 hours. Then, 10,000 test charts are printed. Next, 10 halftone images in which the image density ID is from 0.40 to 0.60 are printed on the entire surfaces and the tenth printed image is set to an image sample for evaluation.

With regard to the image samples for evaluation, color streak contamination caused by toner filming is visually inspected for determination based on the following indices. A and B are acceptable. The evaluation results are shown in Table 1.

A: No color streak contamination is found

B: Small color streak contamination is found but is in a acceptable range

C: Clear color streak contamination is found

With regard to the same image samples for evaluation, background fogging caused by electric charge leakage is visually inspected for determination based on the following indices. A and B are acceptable. The evaluation results are shown in Table 1.

A: Almost no background fogging is visually observed

B: Some defects are visually observed, but cannot be recognized as background fogging c: Some defects are visually observed, and can be recognized as background fogging

Example 2

Preparation of External Additive-Added Toner 2

2 parts of Treatment external additive 2 is added with respect to 100 parts of Toner particles 1 and blended using a sample mill. As a result, External additive-added toner 2 is obtained.

Preparation of Developer 2

Developer 2 is obtained in the same preparation method as that of Developer 1, except that External additive-added toner 2 is used instead of External additive-added toner 1.

Using Developer 2 thus obtained, the same test as that of Example 1 is conducted. The results thereof are shown in Table 1.

Example 3

Preparation of External Additive-Added Toner 3

2 parts of Treatment external additive 3 is added with respect to 100 parts of Toner particles 1 and blended using a sample mill. As a result, External additive-added toner 3 is obtained.

Preparation of Developer 3

Developer 3 is obtained in the same preparation method as that of Developer 1, except that External additive-added toner 3 is used instead of External additive-added toner 1.

Using Developer 3 thus obtained, the same test as that of Example 1 is conducted. The results thereof are shown in Table 1.

Example 4

Preparation of External Additive-Added Toner 4

2 parts of Treatment external additive 4 is added with respect to 100 parts of Toner particles 1 and blended using a sample mill. As a result, External additive-added toner 4 is obtained.

Preparation of Developer 4

Developer 4 is obtained in the same preparation method as that of Developer 1, except that External additive-added toner 4 is used instead of External additive-added toner 1.

Using Developer 4 thus obtained, the same test as that of Example 1 is conducted. The results thereof are shown in Table 1.

Example 5

Preparation of External Additive-Added Toner 5

2 parts of Treatment external additive 5 is added with respect to 100 parts of Toner particles 1 and blended using a sample mill. As a result, External additive-added toner 5 is obtained.

Preparation of Developer 5

Developer 5 is obtained in the same preparation method as that of Developer 1, except that External additive-added toner 5 is used instead of External additive-added toner 1.

Using Developer 5 thus obtained, the same test as that of Example 1 is conducted. The results thereof are shown in Table 1.

Example 6

Preparation of External Additive-Added Toner 6

2 parts of Treatment external additive 6 is added with respect to 100 parts of Toner particles 1 and blended using a sample mill. As a result, External additive-added toner 6 is obtained.

Preparation of Developer 6

Developer 6 is obtained in the same preparation method as that of Developer 1, except that External additive-added toner 6 is used instead of External additive-added toner 1.

Using Developer 6 thus obtained, the same test as that of Example 1 is conducted. The results thereof are shown in Table 1.

Example 7

Preparation of External Additive-Added Toner 7

2 parts of Treatment external additive 7 is added with respect to 100 parts of Toner particles 1 and blended using a sample mill. As a result, External additive-added toner 7 is obtained.

Preparation of Developer 7

Developer 7 is obtained in the same preparation method as that of Developer 1, except that External additive-added toner 7 is used instead of External additive-added toner 1.

Using Developer 7 thus obtained, the same test as that of Example 1 is conducted. The results thereof are shown in Table 1.

Example 8

Preparation of External Additive-Added Toner 8

2 parts of Treatment external additive 2 is added with respect to 100 parts of Toner particles 2 and blended using a sample mill. As a result, External additive-added toner 8 is obtained.

Preparation of Developer 8

Developer 8 is obtained in the same preparation method as that of Developer 1, except that External additive-added toner 8 is used instead of External additive-added toner 1.

Using Developer 8 thus obtained, the same test as that of Example 1 is conducted. The results thereof are shown in Table 1.

Example 9

Preparation of External Additive-Added Toner 9

2 parts of Treatment external additive 2 is added with respect to 100 parts of Toner particles 3 and blended using a sample mill. As a result, External additive-added toner 9 is obtained.

Preparation of Developer 9

Developer 9 is obtained in the same preparation method as that of Developer 1, except that External additive-added toner 9 is used instead of External additive-added toner 1.

Using Developer 9 thus obtained, the same test as that of Example 1 is conducted. The results thereof are shown in Table 1.

Example 10

Preparation of External Additive-Added Toner 10

6 parts of Treatment external additive 8 is added with respect to 100 parts of Toner particles 1 and blended using a sample mill. As a result, External additive-added toner 10 is obtained.

Preparation of Developer 10

Developer 10 is obtained in the same preparation method as that of Developer 1, except that External additive-added toner 10 is used instead of External additive-added toner 1.

Using Developer 10 thus obtained, the same test as that of Example 1 is conducted. The results thereof are shown in Table 1.

Example 11

Preparation of External Additive-Added Toner 11

2 parts of Treatment external additive 9 is added with respect to 100 parts of Toner particles 1 and blended using a sample mill. As a result, External additive-added toner 11 is obtained.

Preparation of Developer 11

Developer 11 is obtained in the same preparation method as that of Developer 1, except that External additive-added toner 11 is used instead of External additive-added toner 1.

Using Developer 11 thus obtained, the same test as that of Example 1 is conducted. The results thereof are shown in Table 1.

Comparative Example 1

Preparation of External Additive-Added Toner 11

2 parts of Treatment external additive 10 is added with respect to 100 parts of Toner particles 1 and blended using a sample mill. As a result, External additive-added toner 11 is obtained.

Preparation of Developer 11

Developer 11 is obtained in the same preparation method as that of Developer 1, except that External additive-added toner 11 is used instead of External additive-added toner 1.

Using Developer 11 thus obtained, the same test as that of Example 1 is conducted. The results thereof are shown in Table 1.

Comparative Example 2

Preparation of External Additive-Added Toner 12

2 parts of Treatment external additive 11 is added with respect to 100 parts of Toner particles 1 and blended using a sample mill. As a result, External additive-added toner 12 is obtained.

Preparation of Developer 12

Developer 12 is obtained in the same preparation method as that of Developer 1, except that External additive-added toner 12 is used instead of External additive-added toner 1.

Using Developer 12 thus obtained, the same test as that of Example 1 is conducted. The results thereof are shown in Table 1.

Comparative Example 3

Preparation of External Additive-Added Toner 13

2 parts of Treatment external additive 12 is added with respect to 100 parts of Toner particles 1 and blended using a sample mill. As a result, External additive-added toner 13 is obtained.

Preparation of Developer 13

Developer 13 is obtained in the same preparation method as that of Developer 1, except that External additive-added toner 13 is used instead of External additive-added toner 1.

Using Developer 13 thus obtained, the same test as that of Example 1 is conducted. The results thereof are shown in Table 1.

TABLE 1

| | Toner Particles | Treatment External Additive (Inorganic Particles) | Saturated Hydrocarbon | Number of Carbon Atoms | Range of Number of Carbon Atoms | % by Weight of Range Of Number Of Carbon Atoms Of 5 Or Less | Treatment Amount (With respect to Toner) | Color Streak Due to Toner Filming | Background Fogging due to Electric Charge Leakage |
|---|---|---|---|---|---|---|---|---|---|
| Example 1 | Toner 1 | 1 (silica) | mixture of nonane, decane, undecane, and eicosane (mixing ratio = 6:10:3:1) | C9 Linear C10 Linear C11 Linear C20 Linear | 3 | 95% | 0.50 wt % | A | B |
| Example 2 | Toner 1 | 2 (silica) | eicosane | C20 Linear | 1 | 100% | 0.50 wt % | A | A |
| Example 3 | Toner 1 | 3 (silica) | dotriaconiane | C32 Linear | 1 | 100% | 0.50 wt % | A | B |
| Example 4 | Toner 1 | 4 (silica) | eicosane | C20 Linear | 1 | 100% | 0.10 wt % | A | B |
| Example 5 | Toner 1 | 5 (silica) | Isopart-M | C13 to C17 Branched | 5 | 100% | 0.50 wt % | A | B |
| Example 6 | Toner 1 | 6 (silica) | cyclododecane | C12 Cyclic | 1 | 100% | 0.50 wt % | A | A |
| Example 7 | Toner 1 | 7 (titanium oxide) | eicosane | C20 Linear | 1 | 100% | 0.50 wt % | A | A |
| Example 8 | Toner 2 | 2 (silica) | eicosane | C20 Linear | 1 | 100% | 0.50 wt % | A | A |
| Example 9 | Toner 3 | 2 (silica) | eicosane | C20 Linear | 1 | 100% | 0.50 wt % | A | A |
| Example 10 | Toner 1 | 8 (silica) | eicosane | C20 Linear | 1 | 100% | 5.5 wt % | A | B |
| Example 11 | Toner 1 | 9 (silica) | mixture of eicosane and dotriacontane (mixing ratio = of 4:1) | C20 Linear C32 Linear | 1 | 80% | 0.50 wt % | A | B |
| Comparative Example 1 | Toner 1 | 10 (silica) | dimethyl silicone oil | — | — | — | 0.50 wt % | A | C |
| Comparative Example 2 | Toner 1 | 11 (silica) | heptane | C7 Linear | 1 | 100% | 0.50 wt % | A | C |
| Comparative Example 3 | Toner 1 | 12 (silica) | n-octatriacontane | C38 Linear | 1 | 100% | 0.50 wt % | A | C |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles containing a colorant, a binder resin, and a release agent; and an external additive, wherein the external additive contains inorganic particles which include saturated hydrocarbons having from 9 to 35 carbon atoms on surfaces thereof.

2. The electrostatic charge image developing toner according to claim 1, wherein the saturated hydrocarbons have from 12 to 30 carbon atoms.

3. The electrostatic charge image developing toner according to claim 1, wherein a content of the saturated hydrocarbons is in a range of 1% by weight to 30% by weight with respect to a total weight of the inorganic particles.

4. The electrostatic charge image developing toner according to claim 1, wherein 50% by area or more of the surfaces of the inorganic particles are coated with the saturated hydrocarbons.

5. The electrostatic charge image developing toner according to claim 1, wherein the saturated hydrocarbons are selected from the group consisting of nonane, decane, undecane, dodecane, tridecane, tetradecane, pentadecane, hexadecane, heptadecane, octadecane, nonadecane, icosane, henicosane, docosane, tricosane, tetracosane, pentacosane, hexacosane, heptacosane, octacosane, nonacosane, triacontane, hentriacontane, dotriacontane, and tritriacontane.

6. The electrostatic charge image developing toner according to claim 1, wherein a volume average primary particle diameter of the inorganic particles is in a range of 7 nm to 300 nm.

7. The electrostatic charge image developing toner according to claim 1, wherein a volume average primary particle diameter of the inorganic particles is in a range of 40 nm to 130 nm.

8. The electrostatic charge image developing toner according to claim 1, wherein a content of inorganic particles having the saturated hydrocarbons on the surfaces thereof is in a range of 0.3% by weight to 10% by weight with respect to a total weight of the toner.

9. The electrostatic charge image developing toner according to claim 1, wherein the toner particles contain 2% by weight to 30% by weight of crystalline polyester resin with respect to a total weight of the toner particles.

10. An electrostatic charge image developer comprising:

the toner according to claim 1; and a carrier.

11. The electrostatic charge image developer according to claim 10, wherein a content of the saturated hydrocarbons is in a range of 0.1% by weight to 5.5% by weight with respect to a total weight of the toner.

12. A toner cartridge comprising:

a toner containing chamber that contains the electrostatic charge image developing toner according to claim 1.

13. A developer cartridge comprising:

a developer containing chamber that contains the electrostatic charge image developer according to claim 10.

14. A process cartridge for an image forming apparatus comprising:

a developer holding member that holds and carries an electrostatic charge image developer, wherein the electrostatic charge image developer is the electrostatic charge image developer according to claim 10.

15. The process cartridge for an image forming apparatus according to claim 14, wherein a content of the saturated hydrocarbons is in a range of 0.1% by weight to 5.5% by weight with respect to a total weight of the electrostatic charge image developing toner.

16. An image forming apparatus comprising:

an image holding member;

a charging unit that charges a surface of the image holding member;

a latent image forming unit that forms an electrostatic latent image on the surface of the image holding member;

a developing unit that forms a toner image by developing the electrostatic latent image, which is formed on the surface of the image holding member, using a developer; and a transfer unit that transfers the formed toner image onto a recording medium, wherein the developer is the electrostatic charge image developer according to claim 10.

17. The image forming apparatus according to claim 16, wherein a content of the saturated hydrocarbons is in a range of 0.1% by weight to 5.5% by weight with respect to a total weight of the electrostatic charge image developing toner.

18. An image forming method comprising:

charging a surface of an image holding member;

forming an electrostatic latent image on the surface of the image holding member;

forming a toner image by developing the electrostatic latent image, which is formed on the surface of the image holding member, using a developer; and transferring the formed toner image onto a recording medium, wherein the developer is the electrostatic charge image developer according to claim 10.

19. The image forming method according to claim 18, wherein a content of the saturated hydrocarbons is in a range of 0.1% by weight to 5.5% by weight with respect to a total weight of the electrostatic charge image developing toner.

* * * * *